US005286275A

United States Patent [19]

Murakami et al.

[11] Patent Number: 5,286,275

[45] Date of Patent: Feb. 15, 1994

[54] POWDER MIXTURE FOR POWDER METALLURGY AND BINDER THEREFOR

[75] Inventors: Masahiro Murakami; Hironori Suzuki; Hitoshi Sakuma; Takehiko Hayami, all of Kobe; Jiro Chosokabe, Miki, all of Japan

[73] Assignee: Kabushiki Kaisha Kobe Seiko Sho, Kobe, Japan

[21] Appl. No.: 872,120

[22] Filed: Apr. 22, 1992

[30] Foreign Application Priority Data

Apr. 22, 1991 [JP] Japan ..... 3-119241
Mar. 4, 1992 [JP] Japan ..... 4-83400

[51] Int. Cl.[5] ..... C22C 1/10
[52] U.S. Cl. ..... 75/252; 524/440
[58] Field of Search ..... 75/229, 252, 255; 524/440, 575

[56] References Cited

U.S. PATENT DOCUMENTS 4,437,882 3/1984 Umemura et al. ..... 75/252

FOREIGN PATENT DOCUMENTS 58-21441 2/1983 Japan ..... 524/440

*Primary Examiner*—George Wyszomierski
*Attorney, Agent, or Firm*—Oblon, Spivak, McClelland, Maier & Neustadt

[57] ABSTRACT

A powder mixture for powder metallurgy comprising a starting powder for powder metallurgy containing a metal powder, a powder of physical property improving ingredients and a lubricant and, blended therewith as a binder, a synthetic styrenic rubber copolymer comprising:

5 to 75 parts by weight of styrene and
95 to 25 parts by weight of butadiene and/or isoprene, as the monomer ingredient or a hydrogenation product thereof. The binder can suppress the segregation of the physical property improver and the lubricant, as well as dusting upon handling the powder.

7 Claims, 2 Drawing Sheets

POWDER MIXTURE FOR POWDER METALLURGY AND BINDER THEREFOR

BACKGROUND OF THE INVENTION

1. Field of the Invention

The present invention concerns a powder mixture for powder metallurgy and a binder used therefor. A starting powder for powder metallurgy comprising a metal powder such as an iron powder or a steel powder as a basic component and, blended therewith, a powder of physical property improving ingredients such as alloying elements and graphite and a lubricant powder is incorporated with a copolymer ingredient of a predetermined composition ratio, so that segregation of the powder of physical property improving ingredient and the lubricant powder is suppressed without deteriorating the physical property of the metal powder as the base component and dusting of the powder upon handling is suppressed.

2. Description of the Prior Art

In powder metallurgy using a metal powder such as an iron powder or a steel powder as the main starting material, alloying elements such as copper, nickel, chromium and molybdenum, a powder of physical property improving ingredients such as graphite, phosphorus and sulfur and a lubricant powder such as zinc stearate are sometimes blended in order to improve the physical property (such as strength characteristics or workability) of sintering products. Usually, particle size, specific gravity, etc. of the powder of physical property improving ingredients and the lubricant powder vary considerably. For instance, since each specific gravity differs in a case where the base metal powder is an iron powder or a steel powder (hereinafter collectively referred to as an iron-steel powder, and the powder of physical property improving ingredients is graphite, phosphorous or the like, the difference of the specific gravity tends to cause segregation in the course of handling after mixing up to molding to worsen the characteristics and the homogeneity of sintering products. Further, if the lubricant powder used for extending the die life causes segregation, it sometimes results in increase of the drawing pressure upon taking out a molding product from the die or causes fluctuation in the powder characteristics.

As a means for preventing such segregation, methods of depositing, for example, a graphite powder to an iron/steel powder or the like by using a organic binder have been proposed as disclosed in Japanese Patent Laid Open Sho 56-136901 and Sho 63-103001.

However, since the organic binders as disclosed in the above-mentioned literatures are hydrophilic, they involve a problem of absorbing moisture to lower the flowability during storage or promoting rusting of the base metal powder, which may rather worsen the quality of powder metallurgy products. Further, since the organic binder has a greater effect of increasing the bonding strength between the iron/steel powders each other rather than increasing the bonding strength between the iron/steel powder and the powder of physical property improving ingredients or the lubricant powder, the effect of preventing segregation of graphite or the like is insufficient and a great amount of the binder has to be blended in order to obtain the more excellent effect. As a result, since the bonding (agglomeration) between each of the iron/steel powders become remarkable, steps of repulverization or sieving after mixing and drying are indispensable.

OBJECT OF THE INVENTION

The present invention has been accomplished in view of the foregoing situations and an object thereof is to provide a powder mixture for powder metallurgy which is free from problems such as denaturation and lowering of flowability in a base metal powder or agglomeration between each of base metal powders, capable of preventing unsatisfactory dispersion, that is, segregation of the powder of physical property improving ingredients or the lubricant powder, as well as capable of suppressing dusting upon handling.

SUMMARY OF THE INVENTION

The foregoing object of the present invention can be attained by a powder mixture for powder metallurgy comprising a starting powder for powder metallurgy containing a metal powder, a powder of physical property improving ingredients and a lubricant powder and, blended therewith as a binder, a synthetic styrenic rubber copolymer comprising:

5 to 75 parts by weight of styrene and 95 to 25 parts by weight of butadiene and/or isoprene as monomer ingredients, or a hydrogenation product thereof.

The copolymer or the hydrogenation product thereof described above has a commercial value per se as a binder for the starting powder used for metallurgy.

The present inventors have made various studies for overcoming the foregoing problems in the prior art and, as a result, it has been confirmed that the foregoing problems can be dissolved altogether by using the specific copolymer as described above. That is, segregation of the powder of physical property improving ingredients and the lubricant powder can be prevented effectively without causing problems such as denaturation, agglomeration or lowering of flowability of the base metal powder, and dusting upon handling of the powder mixture can be suppressed as well.

DESCRIPTION OF THE ACCOMPANYING DRAWINGS

These and other objects, as well as advantageous features of the present invention will become apparent by reading the descriptions for the preferred embodiments of the present invention with reference to the accompanying drawings, wherein FIG. 1 is a flow chart illustrating the method of experiment; and FIG. 2 is a cross sectional view of an instrument used for the measurement of a graphite scattering ratio.

DETAILED DESCRIPTION OF THE INVENTION

Description will now be made to the reason for defining the monomer composition in the copolymer as a binder along with the progress of experiment.

Figure 1:
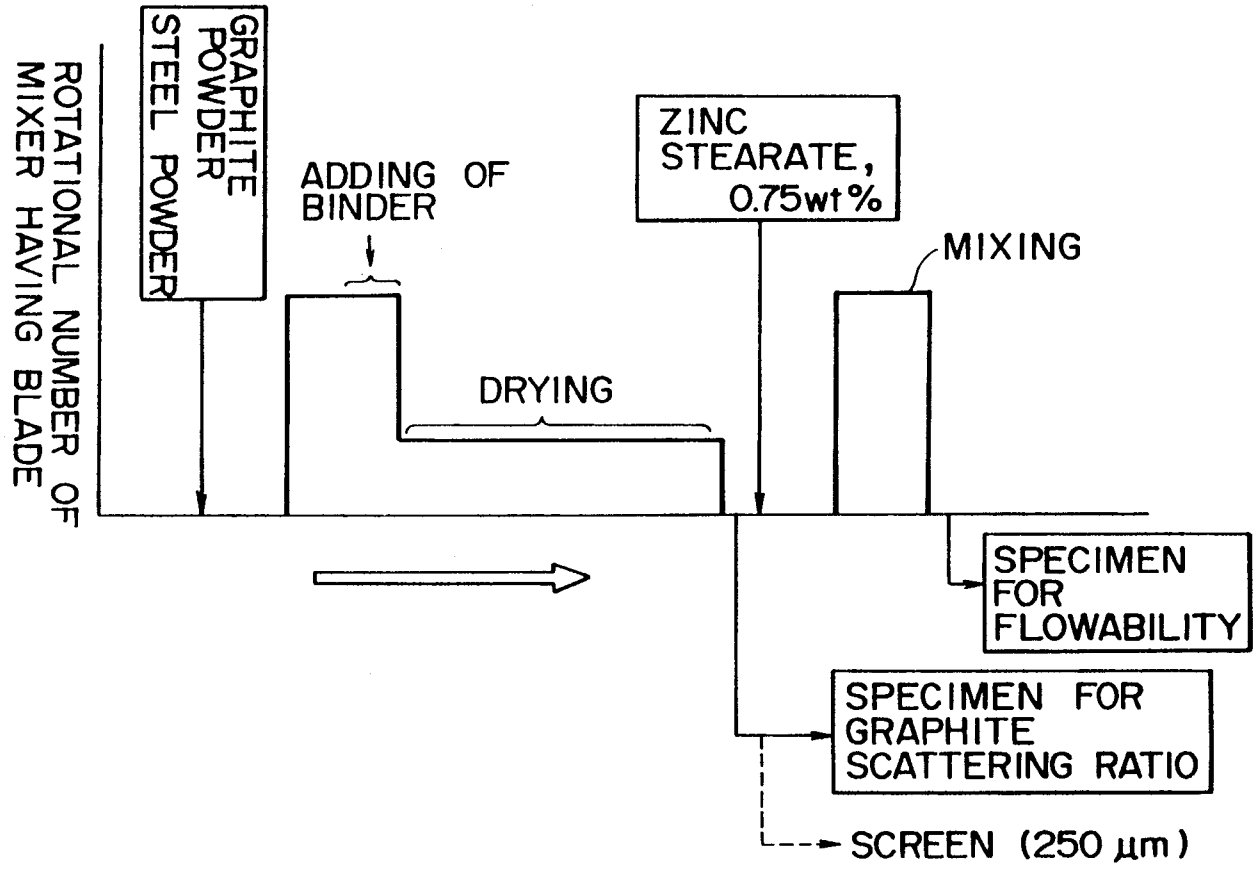

In the experiment as shown in FIG. 1 (flow chart), an steel powder as the base metal powder ("ATOMEL 300M," trade name of product manufactured by Kobe Steel, Ltd., particle size: less than 180 microns) and a graphite powder ("1651J, trade name of product manufactured by South Western Co. average particle size: 2 microns) were prepared and a mixture of them comprising 99 parts by weight of the former and 1 part by weight of the latter was used.

While stirring the starting powder at a high speed by a mixer having a blade, an organic binder solution to be described later is dropped or sprayed and, after stirring intensely for about 5 min, it was switched to a moderate stirring and then they were dried for a predetermined period of time to remove the solvent. Then, a portion of the dried powder was extracted as a specimen for the measurement of a graphite scattering ratio. 0.75% by weight of a zinc stearate powder was added as a lubricant to the remaining dry powder and they were stirred to prepare a specimen for the measurement of flowability. In a case of using the lubricant, the graphite powder and the lubricant can also be deposited simultaneously by means of a binder to the base metal powder.

Figure 2:
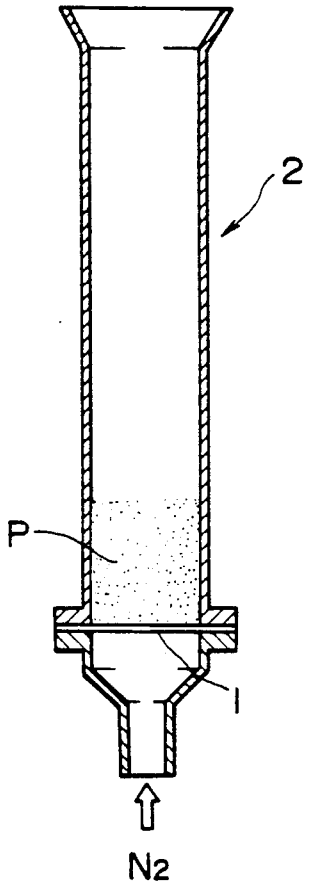

For the measurement of the graphite scattering ratio, a funnel type glass tube 2 (inner diameter: 16 mm, height: 106 mm) attached with a nuclipore filter (12 microns mesh) as shown in FIG. 2 was used, in which the specimen powder P (25 g) obtained as above was placed and $N_2$ gas was caused to flow from below at a rate of 0.8 e/min for 20 minutes, to determine the graphite scattering ratio by the following equation:

Graphite scattering ratio (%)=(1−carbon amount after $N_2$ gas passage/carbon amount before $N_2$ gas passage)×100

Further, the flowability was determined according to JIS-Z-2502.

As an example, an effect of the copolymerization ratio on the graphite scattering ratio and the flowability of the powder mixture was examined, in a case of using styrene and butadiene as the monomer ingredients constituting the binder, and the results are shown in Table 1.

TABLE 1

| Binder | | | | | Graphite | |
|---|---|---|---|---|---|---|
| Copolymer Composition (wt %) | | Weight average molecular | Binder concentration | Binder blending amount to starting powder | scattering ratio | Flowability (sec/50 g) |
| Styrene | Butadiene | weight | in toluene solution (%) | (solid content: %) | (%) | (Zn—St added) |
| 100 | — | about 100,000 | 5 | 0.2 | 5.4 | 26.8 |
| 80 | 20 | about 100,000 | 5 | 0.2 | 3.8 | 26.9 |
| 70 | 30 | about 100,000 | 5 | 0.2 | 2.7 | 27.0 |
| 60 | 40 | about 100,000 | 5 | 0.2 | 1.2 | 27.2 |
| 40 | 60 | about 100,000 | 5 | 0.2 | 0 | 28.5 |
| 30 | 70 | about 100,000 | 5 | 0.2 | 0 | 29.0 |
| 20 | 80 | about 100,000 | 5 | 0.2 | 0 | 31.4 |
| 10 | 90 | about 100,000 | 5 | 0.2 | 0 | 34.2 |
| 5 | 95 | about 100,000 | 5 | 0.2 | 0 | poor |
| — | 100 | about 100,000 | 5 | 0.2 | 0 | poor |

Zn—St: Zinc stearate (lubricant)

As apparent from Table 1, if the copolymerization ratio of styrene is less than 5 parts (on the weight basis here and hereinafter), although the graphite scattering ratio is suppressed, the flowability of the powder mixture is worsened to bring about a problem in the dust core moldability. On the other hand, if the copolymerization ratio of styrene exceeds 75 parts, the graphite scattering ratio can not be lowered sufficiently and the function as the binder can not be provided sufficiently. Accordingly, for satisfying the graphite scattering ratio and the flowability at the same time, the copolymerization ratio of the styrene to butadiene has to be defined within a range of 5–75 parts/95–25 parts. For such a trend, substantially the same effect can also be obtained in a case of using isoprene as the monomer ingredient to be copolymerized with styrene, using butadiene and isoprene together or using a hydrogenation product thereof.

Table 2 shows the performance of a ternary copolymer comprising butyl acrylate-methylmethacrylateacrylic acid at a ratio of 57:38:5 (weight ratio) selected as a typical example of other organic binders (Comparative Example: weight average molecular weight: about 50,000), and the binder according to the present invention (copolymer of styrene and butadiene at a ratio of 35:65 by weight average molecular weight: about 10,000) in comparison.

The experimental method is the same as described above. As can be seen from the table, the binder according to the present invention is excellent both in the graphite scattering ratio and the flowability as compared with other organic binders.

TABLE 2

| Kind of binder | Binder concentration in toluene solution (%) | Binder blending amount to starting powder (solid content: %) | Graphite scattering ratio (%) | Flowability (sec/50 g) |
|---|---|---|---|---|
| S-B copolymer (Example) | 10 | 0.2 | 2.7 | 26.8 |
| A-MMA copolymer (Comp. Example) | 10 | 0.2 | 20.4 | 27.8 |

S-B copolymer = styrene-butadiene copolymer
A-MMA copolymer = acrylic acid-methylmethacrylate copolymer A preferred copolymer composition of the binder used in the present invention is as described above. When it is used, the binder has to be prevailed uniformly throughout the powder mixing system in the mixing step, and has to be bonded effectively with the powder of the physical property improving ingredients and the lubricant powder while just covering the surface of the base metal powder uniformly For this purpose, it is considered that the concentration and the addition amount of the binder to the starting powder are important as well. In view of the above, a binary copolymer of styrene and butadiene at 35:65 ratio (weight average molecular weight: about 100,000) was used and an experiment was conducted for making the effect of the concentration and the addition amount of the binder in the toluene solution on the graphite scattering ratio. In this experiment, the drying time ratio giving an effect on the productivity (the ratio of time based on the drying time of 1.00 assumed in a case where the concentration of the binder in the toluene solution is 5% and the blending amount of the binder, as the solid content, to the starting powder is 0.1%) was also examined. The results are shown in Table 3.

TABLE 3

| Addition amount of binder (%) | | | | Binder solution |
|---|---|---|---|---|
| Binder Conc. in toluene solution (%) | Binder blend amount to starting powder (solid: %) | Graphite scattering ratio (%) | Drying time ratio | blending amount to starting powder (%) |
| 2.5 | 0.03 | 8.5 | 0.4 | 1.2 |
| | 0.05 | 7.1 | 1.0 | 2.0 |
| | 0.10 | 3.2 | 2.1 | 4.0 |
| 5 | 0.05 | 6.5 | 0.4 | 1.0 |
| | 0.10 | 1.0 | 1.0 | 2.0 |
| | 0.15 | 0 | 1.8 | 3.0 |
| | 0.20 | 1.1 | 2.4 | 4.0 |
| 10 | 0.10 | 2.9 | 0.5 | 1.0 |
| | 0.15 | 0.7 | 0.8 | 1.5 |
| | 0.20 | 0 | 1.1 | 2.0 |
| | 0.25 | 0 | 1.4 | 2.5 |
| 15 | 0.15 | 1.7 | 0.5 | 1.0 |
| | 0.30 | 0 | 1.1 | 2.0 |

As apparent from Table 3, upon addition of the binder (binary copolymer), it has to be taken into consideration not only the solution concentration of the binder and the addition amount as the solid content to the starting powder but also the addition amount of the binder solution to the starting powder. If the amount of the binder solution is insufficient, it can not be prevailed uniformly to the entire surface of the iron powder, to result in insufficient bonding which makes it difficult to sufficiently suppress the segregation and graphite scattering. On the other hand, if the addition amount is excessively high, segregation of the binder solution itself occurs in the mixing system to cause uneven mixing, which partially results in an insufficient portion of the binding force, making it difficult to attain the aimed purpose.

Accordingly, upon addition of the binder, the addition amount as the solution is preferably controlled within a range from 1.0 to 3.0% based on the starting powder. If the absolute amount of the binder as the solid is insufficient, the binding force after drying becomes insufficient. On the other hand, if it is excessive, the powder mixture agglomerates partially to necessitate repulverization and, accordingly, the addition amount as the solid is desirably from 0.1 to 0.3% and, more preferably, 0.1 to 0.2%.

Further, although the preferred concentration of the solution can not be defined generally since it varies depending on the molecular weight of the ternary copolymer (polymerization degree) and the viscosity of the solution depending thereof, the concentration used is usually from 5 to 15% and, preferably, 5 to 10%.

A preferred molecular weight of the synthetic styrenic rubber copolymer according to the present invention, ranges from 10,000 to 1,000,000, more preferably, 30,000 to 500,000 based on the weight average molecular weight. If the molecular weight is too low, the effect as the binder tends to become insufficient entirely and, on the other hand, if it is excessive, uneven mixing is caused and the effect of preventing the segregation can not be provided sufficiently.

Then Table 4 shows the result of using a styrene-butadiene (35:65) copolymer (weight average molecular weight: about 100,000) as the binder according to the method as described above and examining the graphite scattering ratio and the agglomeration property (residual ratio on a 250 microns mesh screen) while varying the concentration of the solution and the addition amount of the binder and a flowability and compressiveness when 0.75% of a zinc stearate powder is admixed thereto (specimen size, 11.3 mm in diameter × 10 mm in height, compacting pressure: 5 t/cm$^2$). In this table, examples not adding the binder are also shown together for the comparison.

TABLE 4

| | Binder | | | | | | |
|---|---|---|---|---|---|---|---|
| Binder | Binder concentration in toluene solution (%) | Binder blending amount to starting powder (solid content: %) | Binder solution blending amount to starting powder (%) | Graphite scatting ratio (%) | Coagulation property (sieve + 250 μm) (%) | Flowability | Compressive property (5 ton/cm$^2$) |
| Copolymer | 5 | 0.10 | 2.0 | 3.2 | 0 | 28.9 | 6.92 |
| | 6 | 0.12 | 2.0 | 1.5 | 0 | 28.5 | 6.92 |
| | 6 | 0.24 | 4.0 | 0 | 0.02 | 26.4 | 6.89 |
| | 8 | 0.12 | 1.5 | 2.1 | 0 | 28.2 | 6.92 |
| | 8 | 0.16 | 2.0 | 0 | 0 | 27.6 | 6.91 |
| | 8 | 0.20 | 2.5 | 0 | 0.01 | 27.1 | 6.90 |
| | 10 | 0.15 | 1.5 | 0 | 0 | 27.9 | 6.91 |
| | 10 | 0.20 | 2.0 | 0 | 0.01 | 27.5 | 6.90 |
| Not-added | — | — | — | 68 | 0 | 34.7 | 6.91 |

As apparent from Table 4, the graphite scattering ratio is extremely large in the case of not adding the binder, whereas the graphite scattering ratio can be suppressed remarkably by adding an appropriate amount of the binder according to the present invention. Further, descriptions have been made to the experimental example for a case of mixing the graphite powder and the lubricant with the iron powder as an example, but the present invention is applicable also to a case of adding other alloying elements, manganese sulfide, phosphorus, sulfur, etc. to the iron powder or the steel powder for the improvement.

Further, Table 5 shows a result of using a powder mixture comprising an steel powder (ATOMEL "300M," trade name of product manufactured by Kobe Steel, Ltd.; particle size less than 180 microns) as the base metal powder and, blended therewith, 0.8% by weight of a graphite powder (natural graphite: average particle size of 3 microns), 2.0% by weight of a copper powder atomized copper powder: average particle size of 30 microns) and 0.75% by weight of a zinc stearate powder, and examining the graphite scattering ratio and the flowability in the same method as adopted in Table 1. As the binder, a styrene-butadiene copolymer (at 35:65 weight ratio) (weight average molecular weight: about 100,000) was added to the starting powder as a toluene solution at 10% binder concentration and by 0.2% by weight as a solid content, and mixed uniformly.

TABLE 5

| Powder material blend: 2% Cu-0.8%C-0.75% Zn stearate-balance Fe | | | | | | |
|---|---|---|---|---|---|---|
| Binder | | | | | Graphite | |
| Copolymer Composition (wt %) | | Weight average molecular weight | Binder concentration in toluene solution (%) | Binder blending amount to starting powder (solid content: %) | scatting ratio (%) | Flowability (sec/50 g) (Zn—St added) |
| Styrene | Butadiene | | | | | |
| 35 | 65 | About 100,000 | 10 | 0.2 | 0 | 25.8 |

As apparent from the results, according to the present invention, segregation or scattering of the powder of physical property improving ingredients (graphite or the like) and the lubricant powder which are extremely light in the weight and liable to be segregated, can be prevented effectively without deteriorating the flowability (moldability) for use in powder metallurgy.

As has been described above according to the present invention, segregation of the powder of physical property improving ingredients and the lubricant powder in the base metal powder such as iron/steel powder or dusting during handling can be prevented by using, as a binder, a synthetic styrenic rubber copolymer prepared by copolymerizing styrene and butadiene and/or isoprene at a predetermined ratio or a hydrogenation product thereof. As the metal powder for the base, there can be mentioned, for example, most popular iron/steel powder, as well as powders of the metals such as copper powder, bronze powder, Ti powder, Al powder, Ni powder and Co powder or powders of alloys thereof.

Further, as the physical property improving ingredient blended in the metal powder, there can be mentioned various ingredients used for improving various physical properties of metallurgical products such as strength, wear resistance and cutting property. For instance, inorganic powder such as of copper, Ni, Cr, Mo, graphite, MnS, P and S can be exemplified as the inorganic powder for improving the physical property in the iron/steel powder metallurgy product. Since the blending amount of the inorganic powder varies depending on the kind, it can not be defined generally but the blending amount as a ratio to the total amount of the starting powder generally ranges from 0.1 to 3% by weight.

For the powder of physical property improving ingredients, a fine powder with an average particle size usually of less than 50 microns, more preferably, less than 30 microns is preferably used so that the powder is capable of rapidly diffusing or alloying in the base metal through solid phase or liquid phase diffusion in a sintering step. Particularly, in a case of using the graphite powder, since the use of coarse particles tends to give blow holes in the product, it is desirable to use a fine powder of less than 10 microns, preferably, less than 5 microns.

Further, the lubricant powder is blended with an aim of increasing a pressure density by reducing the friction between a die and a powder mixture or between each of individual powdery particles in the powder mixture upon dust core molding, as well as of extending the die life. For instance, metal soap such as zinc stearate, amide wax such as ethylene bisamide or a composite product thereof is used, and the addition amount represented by the ratio to the total amount of the starting powder is usually about from 0.1 to 3% by weight, more generally, 0.3 to 1% by weight.

For the lubricant powder, a powder of somewhat coarse particle size can reduce the resistance upon taking out the molding product from the die, but this tends to worsen the compressiveness and uniform mixing property as the entire powder mixture. Accordingly, it is preferable to use a powder with an average particle size of less than about 50 microns and, more preferably, less than about 30 microns.

The present invention has thus been constituted and, by using a specific copolymer as the binder, the uniform dispersibility and the dusting property of the powder of physical property improve ingredients and the lubricant powder can be improved without giving undesired effects on the base metal powder, as well as the flowability or the moldability as the mixture can be improved, to provide a powder mixture of excellent performance for powder metallurgy.

What is claimed is:

1. A powder mixture for powder metallurgy comprising a starting powder for powder metallurgy containing a metal powder, a powder of physical property improving ingredients and a lubricant and, blended therewith as a binder, a synthetic styrenic rubber copolymer comprising:

5 to 75 parts by weight of styrene and 95 to 25 parts by weight of butadiene and/or isoprene, as the monomer ingredient or a hydrogenation product thereof:

wherein said binder is blended in an amount of 0.1 to 0.3% by weight as a solid content based on 100 parts by weight of the starting powder; and wherein said powder of physical property improving ingredients is one or more of inorganic powders selected from the group consisting of copper, nickel, chromium, molybdenum, graphite, manganese sulfide, phosphorus and sulfur.

2. A powder mixture for powder metallurgy as defined in claim 1, wherein a binder of a weight average molecular weight from 10,000 to 1,000,000 is blended.

3. A powder mixture for powder metallurgy as defined in claim 1 or 2, wherein the metal powder is an iron series powder.

4. A powder mixture for metallurgy as defined in claim 1, wherein the average particle size of the powder of physical property improving ingredients is less than 50 microns.

5. A powder mixture for metallurgy as defined in claim 1 or 4, wherein the blending amount of the powder of physical property improving ingredients to the total amount of the starting powder is at a ratio from 0.1 to 3% by weight.

6. A powder mixture for powder metallurgy as defined in claim 1, wherein the average particle size of the lubricant is less than 50 microns.

7. A powder mixture for powder metallurgy as defined in claim 1 or 6, wherein the lubricant is blended by from 0.1 to 3 wt. % based on 100 parts by weight of the starting powder.

* * * * *